US007757437B2

(12) United States Patent
Schulte et al.

(10) Patent No.: US 7,757,437 B2
(45) Date of Patent: Jul. 20, 2010

(54) RESILIENT RETENTION SYSTEM FOR A DOOR PANEL

(75) Inventors: Peter S. Schulte, East Dubuque, IL (US); Perry Knutson, Lancaster, WI (US); Rodney Kern, Dubuque, IA (US); Bill Hoerner, Dubuque, IA (US); Allan H. Hochstein, Milwaukee, WI (US)

(73) Assignee: Rite-Hite Holding Corporation, Milwaukee, WI (US)

( * ) Notice: Subject to any disclaimer, the term of this patent is extended or adjusted under 35 U.S.C. 154(b) by 59 days.

(21) Appl. No.: 10/754,812

(22) Filed: Jan. 9, 2004

(65) Prior Publication Data

US 2005/0150169 A1 Jul. 14, 2005

(51) Int. Cl.
*E06B 65/10* (2006.01)

(52) U.S. Cl. ..... 49/141; 49/409; 49/411; 49/370; 49/116

(58) Field of Classification Search ..... 49/9, 49/404, 436, 147, 116, 118, 123, 370, 141, 49/409, 410, 411
See application file for complete search history.

(56) References Cited

U.S. PATENT DOCUMENTS

| | | | | |
|---|---|---|---|---|
| 643,307 | A | 2/1900 | Schmitt et al. | |
| 843,011 | A | 2/1907 | Hale et al. | |
| 1,220,910 | A | 3/1917 | Toll | |
| 1,245,882 | A | 11/1917 | Davis | |
| 1,406,951 | A | 2/1922 | Fehr | |
| 1,439,373 | A | 12/1922 | Norwood et al. | |
| 1,534,210 | A | 4/1925 | Griffith et al. | |
| 1,681,545 | A | 4/1928 | Lang | |
| 1,802,519 | A * | 4/1931 | Linstadt | 16/90 |
| 1,960,860 | A | 5/1934 | Allen | |
| 2,373,023 | A | 4/1945 | Goodwin | |
| 2,425,016 | A | 8/1947 | Weaver | |
| 2,517,713 | A | 8/1950 | Rissler | |
| 2,811,406 | A | 10/1957 | Moore et al. | |
| 2,878,532 | A | 3/1959 | Clark | |
| 3,065,826 | A | 11/1962 | Tucker | |

(Continued)

FOREIGN PATENT DOCUMENTS

| | | |
|---|---|---|
| CH | 0196048 | 5/1938 |

(Continued)

OTHER PUBLICATIONS

International Search Report for PCT/US2005/000037, Jul. 11, 2005, 5 Pages.

(Continued)

*Primary Examiner*—Gregory J. Strimbu
(74) *Attorney, Agent, or Firm*—Hanley, Flight & Zimmerman, LLC

(57) ABSTRACT

A horizontally sliding door includes a resilient retention system that helps hold a door panel tightly against its seals when the door is closed, and resiliently releases the door panel when an external force displaces the panel beyond its normal path of travel. If the door panel is displaced off its normal path, the resilience of the retention system or simply opening and closing the door automatically returns the panel back to normal operation. The resilient retention system can be installed off the floor, so the system avoids creating a tripping hazard and avoids being damaged by nearby vehicles.

21 Claims, 18 Drawing Sheets

U.S. PATENT DOCUMENTS

| | | | | | |
|---|---|---|---|---|---|
| 3,074,124 | A | | 1/1963 | Bergstedt | |
| 3,102,581 | A | | 9/1963 | Kochanowski | |
| 3,175,254 | A | | 3/1965 | Bromann | |
| 3,197,817 | A | | 8/1965 | Voris | |
| 3,354,581 | A | * | 11/1967 | Dimmitt et. al. | 49/141 |
| 3,425,162 | A | | 2/1969 | Halpern | |
| 3,432,966 | A | | 3/1969 | Bordner | |
| 3,440,022 | A | * | 4/1969 | Elmore | 422/104 |
| 3,460,290 | A | | 8/1969 | Wutzke | |
| 3,484,812 | A | | 12/1969 | Holland | |
| 3,529,382 | A | | 9/1970 | Salvarola | |
| 3,552,474 | A | | 1/1971 | Finnegan | |
| 3,611,637 | A | | 10/1971 | Saino | |
| 3,734,238 | A | | 5/1973 | Secresty et al. | |
| 3,805,450 | A | | 4/1974 | Forcina | |
| 3,807,480 | A | | 4/1974 | Smart | |
| 3,912,049 | A | | 10/1975 | Holland et al. | |
| 4,058,191 | A | | 11/1977 | Balbo | |
| 4,115,953 | A | * | 9/1978 | Brosenius | 49/125 |
| 4,180,942 | A | | 1/1980 | Saucier | |
| 4,218,104 | A | | 8/1980 | Anderson et al. | |
| 4,404,770 | A | | 9/1983 | Markus | |
| 4,486,980 | A | * | 12/1984 | O'Bar | 49/449 |
| 4,592,270 | A | | 6/1986 | Vener | |
| 4,637,176 | A | | 1/1987 | Acock, Jr. | |
| 4,646,471 | A | | 3/1987 | Shaiu | |
| 4,651,469 | A | * | 3/1987 | Ngian et al. | 49/223 |
| 4,680,828 | A | | 7/1987 | Cook et al. | |
| 4,735,293 | A | | 4/1988 | Everhart et al. | |
| 4,758,299 | A | | 7/1988 | Burke | |
| 4,961,454 | A | | 10/1990 | Reilly et al. | |
| 4,987,638 | A | | 1/1991 | Ribaudo | |
| 5,080,950 | A | | 1/1992 | Burke | |
| 5,083,639 | A | | 1/1992 | Kappeler | |
| 5,165,142 | A | | 11/1992 | Pilsbury | |
| 5,195,594 | A | | 3/1993 | Allen et al. | |
| 5,305,855 | A | | 4/1994 | Rivera et al. | |
| 5,347,755 | A | | 9/1994 | Jaster et al. | |
| 5,383,510 | A | | 1/1995 | Allen | |
| 5,427,205 | A | | 6/1995 | Saillio et al. | |
| 5,590,920 | A | | 1/1997 | Anderson et al. | |
| 5,601,133 | A | | 2/1997 | Krupke et al. | |
| 5,727,614 | A | | 3/1998 | Lichy | |
| 5,737,802 | A | | 4/1998 | Jella | |
| 5,829,504 | A | | 11/1998 | Ekstrand et al. | |
| 5,899,303 | A | | 5/1999 | Allen | |
| 6,041,844 | A | | 3/2000 | Kellogg et al. | |
| 6,053,237 | A | | 4/2000 | Bertilsson et al. | |
| 6,148,897 | A | | 11/2000 | Horner et al. | |
| 6,330,763 | B1 | * | 12/2001 | Kern et al. | 49/231 |
| 6,360,487 | B1 | * | 3/2002 | Kern et al. | 49/231 |
| 6,442,900 | B1 | * | 9/2002 | Kvasnes | 49/409 |
| 2003/0140564 | A1 | | 7/2003 | Delgado et al. | |
| 2004/0261318 | A1 | | 12/2004 | Berry et al. | |
| 2005/0005524 | A1 | | 1/2005 | Berry et al. | |
| 2005/0076570 | A1 | * | 4/2005 | Delgado et al. | 49/141 |

FOREIGN PATENT DOCUMENTS

| | | |
|---|---|---|
| DE | 0573632 | 3/1933 |
| DE | 29808179 | 9/1998 |
| EP | 0478938 | 4/1992 |
| FR | 0980892 | 5/1951 |
| FR | 1514166 | 1/1968 |
| FR | 2191010 | 2/1974 |
| FR | 2315598 | 2/1977 |
| FR | 2582343 | 11/1986 |
| GB | 2219618 | 12/1989 |
| JP | 05118180 | 5/1993 |
| JP | 06032572 | 2/1994 |
| JP | 06072681 | 3/1994 |
| WO | WO 03052226 | 6/2003 |

OTHER PUBLICATIONS

International Searching Authority, *Written Opinion*, Jul. 11, 2005, 8 Pages.

Hercules/AlumaShield Industries, Inc. Product Brochure; "ReFlex Dock Doors"; copyright 2001, 1 page.

Jamison Sound Reduction, Special Purpose, Cold Storage Doorsbrochure, Jamison Door Company, 1988, 8 pages.

"Thermo Isolierende Tursysteme," Manifatture Tecnolegno Hartz, Preisliste (1996) pp. 16-31; Partial translation of pp. 16-19 and full translation.

"*Overhead Door JETROLL*"; Form A-988 Oct. 1995; Copyright Overhead Door Corporation 1995; 14 pages.

*Introducing the SST Smooth Operator System* Brochure; Therm-L-Tec Systems, Inc.; 6 pages; 1990.

Patent Cooperation Treaty, "International Preliminary Report on Patentability," mailed on Mar. 30, 2007, (7 pages).

Canadian Intellectual Property Office, "Office Action," issued in connection with Canadian application serial No. 2,554,895, issued Sep. 23, 2008, 6 pages.

Canadian Intellectual Property Office, "Notice of Allowance," issued in connection with Canadian application serial No. 2,554,895, issued Aug. 4, 2009, 1 page.

State Intellectual Property Office, P.R. China, "First Office Action," issued in connection with Chinese application serial No. 200580007008.X, issued Jun. 26, 2009, 18 pages.

State Intellectual Property Office, P.R. China, "Second Office Action," English translation only, issued in connection with Chinese application serial No. 200580007008.X, issued Jan. 29, 2010, 9 pages.

European Patent Office, "Office Action," issued in connection with European application serial No. 05 704 885.2, issued Jan. 31, 2008, 7 pages.

European Patent Office, "Office Communication," issued in connection with European application No. 05 704 885.2, mailed Apr. 21, 2009, 3 pages.

* cited by examiner

RESILIENT RETENTION SYSTEM FOR A DOOR PANEL

BACKGROUND OF THE INVENTION

1. Field of the Invention

The subject invention generally pertains to what is known as a horizontally sliding door and more specifically to a retention system for such a door.

2. Description of Related Art

So-called horizontally sliding doors (which may actually slide or roll) usually include one or more door panels that are suspended by carriages that travel along an overhead track. The carriages allow the door panels to slide or roll in a generally horizontal direction in front of a doorway to open and close the door. The movement of the panels can be powered or manually operated. Depending on the width of the doorway and the space along either side of it, a sliding door can assume a variety of configurations.

For a relatively narrow doorway with adequate space alongside to receive an opening door panel, a single panel is enough to cover the doorway. Wider doorways with limited side space may require a bi-parting sliding door that includes at least two panels, each moving in opposite directions from either side of the doorway and meeting at the center of the doorway to close the door. For even wider doorways or those with even less side space, multi-panel sliding doors can be used. Multi-panel doors have at least two parallel door panels that overlay each other at one side of the doorway when the door is open. To close the door, one panel slides out from behind the other as both panels move in front of the doorway to cover a span of about twice the width of a single panel. Applying such an arrangement to both sides of the doorway provides a bi-parting door with multiple panels on each side.

Although sliding doors are used in a wide variety of applications, they are particularly useful in providing access to cold-storage lockers, which are rooms that provide large-scale refrigerated storage for the food industry. Doorways into such a room are often rather wide to allow forklift trucks to quickly move large quantities of products in and out of the room. When closing off a refrigerated room, sliding doors are often preferred over roll-up doors and bi-fold doors, because sliding panels can be made relatively thick with insulation to reduce the cooling load on the room.

Thicker panels generally provide better thermal insulation, and a panel's rigidity allows the panel to compress seals against gaskets mounted to the stationary structure surrounding the door. Alternatively, the panel itself may carry compressive seals, and the rigidity allows the panel to accurately position its seals and allows the door panel to transmit (in a direction generally coplanar with the panel) the necessary compressive forces required to tightly engage the seals. Unfortunately, a relatively thick, rigid door does create some problems, especially in cold-storage applications.

With cold-storage rooms, it is important to open and close the door as quickly as possible to minimize the room's cooling load. So, the doors are usually power-actuated, and they are opened and closed automatically in response to sensing the presence of an approaching vehicle, such as a forklift. Although power-actuated, vehicle-sensing systems are effective, occasional collisions between a forklift and a door panel may still occur. If the door panel is relatively thick and rigid, as is the case with typical cold-storage doors, a collision may damage the door panel or other parts of the door.

Damage to a door may be avoided by providing the door with some type of breakaway feature that releases the door panel upon impact. This is easily accomplished with roll-up doors and overhead storing doors (e.g., conventional garage doors) where the door panels or curtain moves vertically between two parallel tracks. The breakaway feature is simply incorporated in the area where the vertical side edges of the door panel travels within its respective vertical track.

Applying a breakaway feature to a horizontally sliding door of a cold storage room, however, is much more complicated because such door panels not only move horizontally, but they may also have some vertical movement to engage the door's lower seal as the door panel comes to its closed position. And a horizontally sliding door may not even have a lower track. The location to mount breakaway hardware is more limited with horizontally sliding doors because the floor underneath the door panel is preferably kept clear of door-related hardware. Floor-mounted hardware can create a tripping hazard and may itself become damaged by vehicles traveling near the doorway.

Nonetheless, some sliding doors do have floor-mounted hardware, such as those disclosed in U.S. Pat. Nos. 4,404,770; 3,611,637 and 4,651,469. The '637 patent has a lower track, but the track apparently is not intended to provide a breakaway function. The same appears to be true for the '770 patent. For the '469 patent, at first glance FIG. 10 makes the door panel appear as though it can breakaway; however, there is no indication that the lower edge of the door panel can actually get past its floor-mounted guide.

Another more interesting sliding door is disclosed in U.S. Pat. No. 6,330,763. This patent discloses how a wall-mounted nylon strap can be used for restraining the lower portion of a door panel. The pliability of the strap enables the door panel to yield under impact and automatically return to its normal position. The strap, being of limited length, effectively tethers the door panel to limit how far the door panel can be displaced, and the slackness or pliability of the strap provides the door panel the freedom to return on its own; however, the nylon strap does not necessarily have the resilience to forcibly draw the panel back into position.

SUMMARY OF THE INVENTION

In some embodiments, a sliding door includes a resilient retention system that enables a door panel to automatically recover from an impact.

In some embodiments, a sliding door includes door panel that is restrained by a resilient connection so that when the panel is forced out of its normal operating path, the connection resiliently draws the door panel back to its normal path.

In some embodiments, an elongate member attached to a spring provides the resilient connection that returns the door panel to normal operation.

In some embodiments, the length of the resilient connection's elongate member can be varied to adjust the restorative force exerted by the resilient connection.

In some embodiments, a track follower yieldably engaging a track provides a resilient connection that allows a door panel to yield under impact.

In some embodiments, opening and closing the door automatically returns the door's panel back to its normal operating path.

In some embodiments, a door panel retention system includes a resilient connection that is attached to and travels with the door panel.

In some embodiments, a door panel retention system includes a resilient connection that is attached to a stationary wall.

In some embodiments, the door panel of a sliding door can yield under impact yet still remain in contact with the panel's resilient retention system.

In some embodiments, a sliding door panel includes a resilient retention system even though the retention system comprises a stationary, rigid track.

DESCRIPTION OF THE PREFERRED EMBODIMENT

Figure 1:
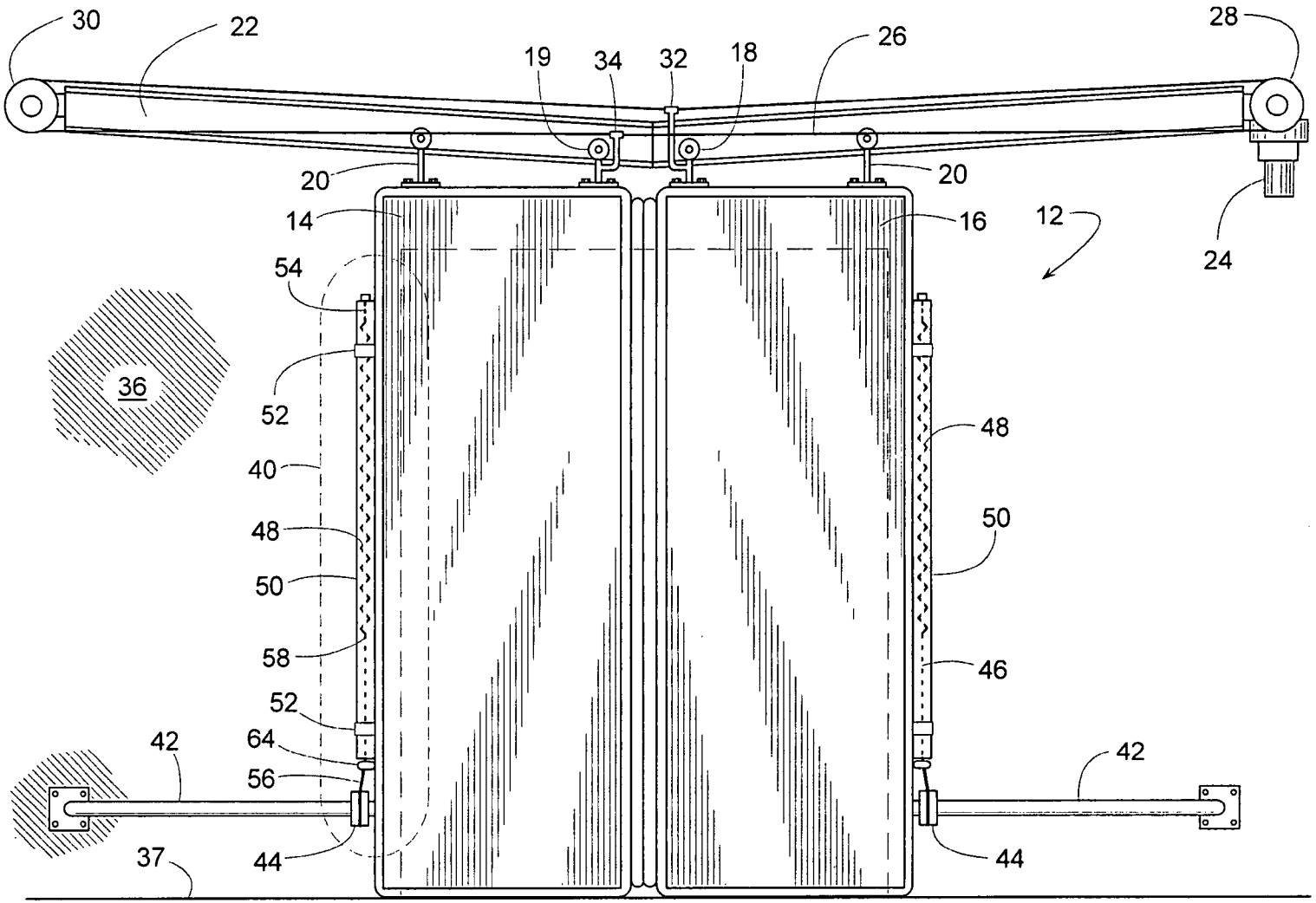
FIG. 1 is a front view of a closed door according to one embodiment.
Figure 2:
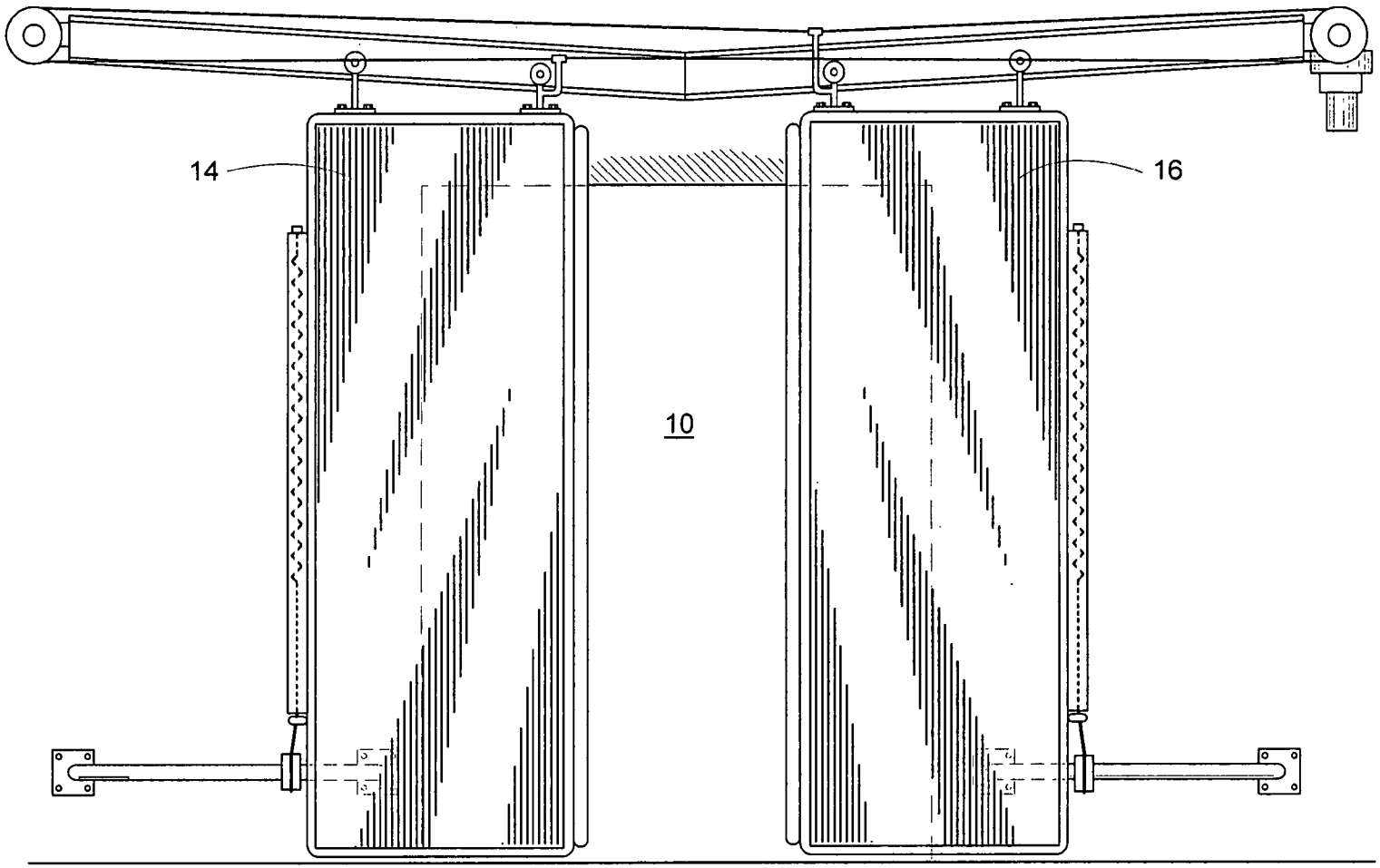
FIG. 2 is a front view of the embodiment of FIG. 1, but with the door partially open.
Figure 3:
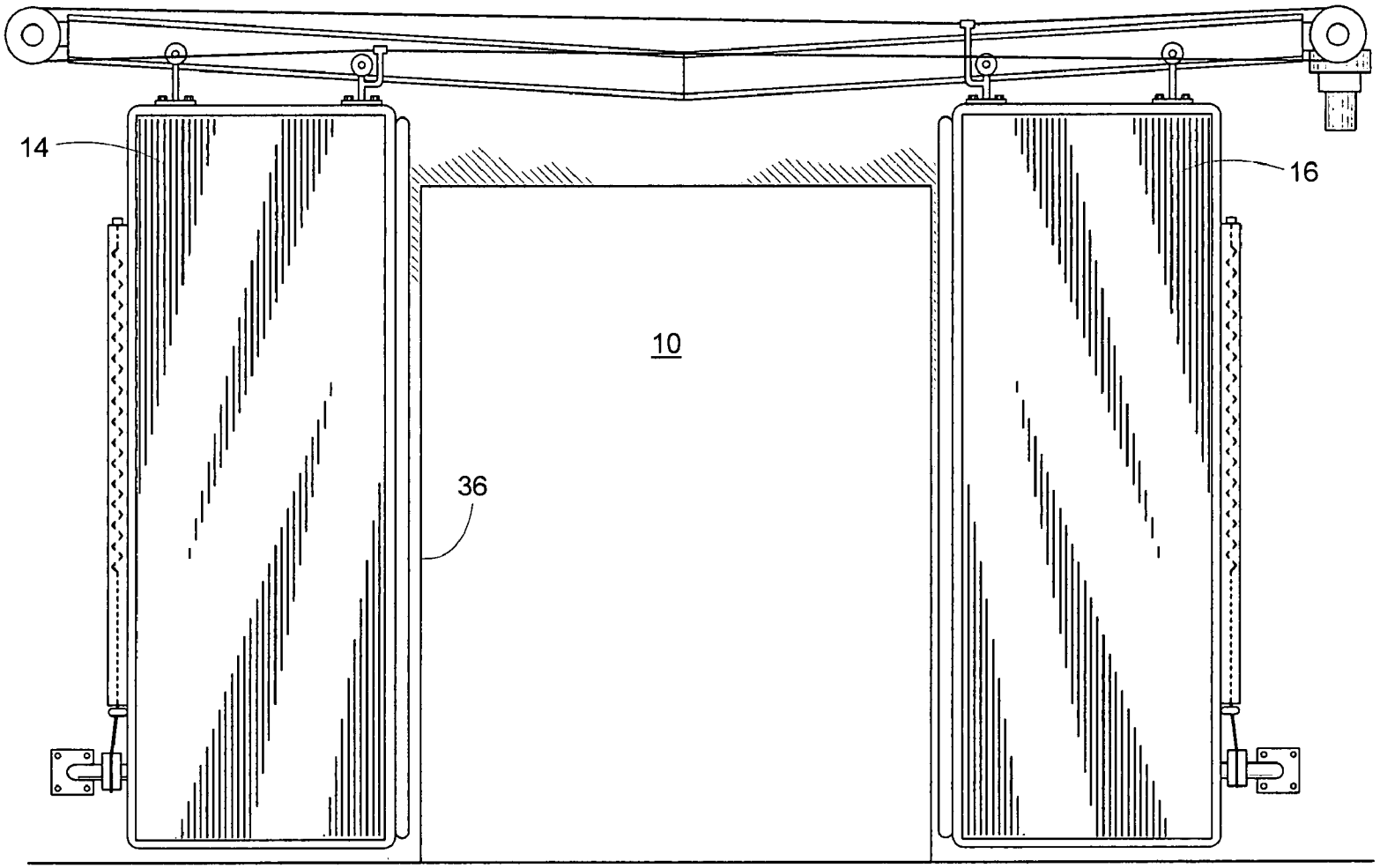
FIG. 3 is a front view of the embodiment of FIG. 1, but with the door substantially fully open.

To seal off a doorway 10 leading to a cold storage locker or other area within a building, a laterally-moving door, such as sliding door 12 is installed adjacent the doorway, as shown FIGS. 1, 2 and 3 with door 12 being shown closed, partially open, and fully open respectively. The terms, "sliding door" and "laterally-moving door" refer to those doors that open and close by virtue of a door panel that moves primarily horizontally in front of a doorway without a significant amount of pivotal motion about a vertical axis. The horizontal movement can be provided by any of a variety of actions including, but not limited to sliding and rolling. Moreover, door 12 does not necessarily have to be associated with a cold storage locker, as it can be used to separate any two areas within a building or used to separate the inside of a building from the outside. Although door 12 will be described with reference to a bi-parting door, it should be appreciated by those of ordinary skill in the art that the invention is readily applied to a variety of other sliding doors including, but not limited to, single-panel sliding doors, multi-panel sliding doors, and combination multi-panel bi-parting doors.

As for the illustrated embodiment, door 12 opens and closes between doorway blocking and unblocking positions by way of two panels 14 and 16 that are mounted for translation or lateral movement across doorway 10. Translation of the panels while inhibiting their rotation about a vertical axis is provided, in this example, by suspending each panel from two panel carriers. Examples of such carriers would include, but not be limited to, sliding carriages or rolling trolleys 18, 19 and 20 that travel along an upper track 22.

Those skilled in the art should appreciate that the operation of a sliding door can be carried out by a variety of well-known actuation systems. Examples of an actuation system for moving a panel laterally relative to the doorway include, but are not limited to, a chain and sprocket mechanism; rack and pinion system; cable/winch system; piston/cylinder (e.g., rodless cylinder); and an electric, hydraulic or pneumatic linear actuator.

One example of an actuation system is best understood with reference to FIGS. 1-3. In this example, door 12 is power-operated by a drive unit 24 that moves panels 14 and 16 either apart or together to respectively open or close door 12. Drive unit 24 includes a chain 26 disposed about a driven sprocket 28 and an idler sprocket 30. If desired, additional idlers can be added near the central portion of track 22. Such additional idlers could pull chain 26 downward near the center of the doorway so that the upper and lower portions of chain 26 are generally parallel to the double-incline shape of track 22. One clamp 32 couples trolley 18 of panel 16 to move with an upper portion of chain 26, and another clamp 34 couples trolley 19 of panel 14 to move with a lower portion of chain 26. Thus, the drive unit's direction of rotation determines whether panels 14 and 16 move together to close the door or apart to open it.

Although track 22 can assume a variety of configurations, in some embodiments, track 22 is mounted to a wall 36 and situated overhead and generally above doorway 10. Track 22 could be straight and level; however, in the embodiment of FIGS. 1-3, track 22 includes inclined surfaces. The inclined surfaces cause the door panels to descend as the door closes so that the panels seal down against the floor. For effective sealing, a suitable sealing material 38 (e.g., foam or inflatable tube) can be added to the perimeter of the door panels and/or around doorway 10.

To help hold the door panels against their seals and to help keep the lower end of the panels traveling within a predetermined normal path directly across the doorway, each door panel 14 and 16 is associated with a panel retention system 40 that engages a lower track 42. In this example, lower track 42 is attached to wall 36; however, track 42 could alternatively be attached to a floor 37 or any other surrounding structure adjacent to door 12. The term, "surrounding structure" refers to any nearby support to which a track can be mounted. Examples of surrounding structure include, but are not limited to a wall, a floor, a doorframe, etc. In this embodiment, each panel retention system 40 comprises a track follower 44 that can slide or otherwise move along track 42 as the door opens and closes.

Figure 4:
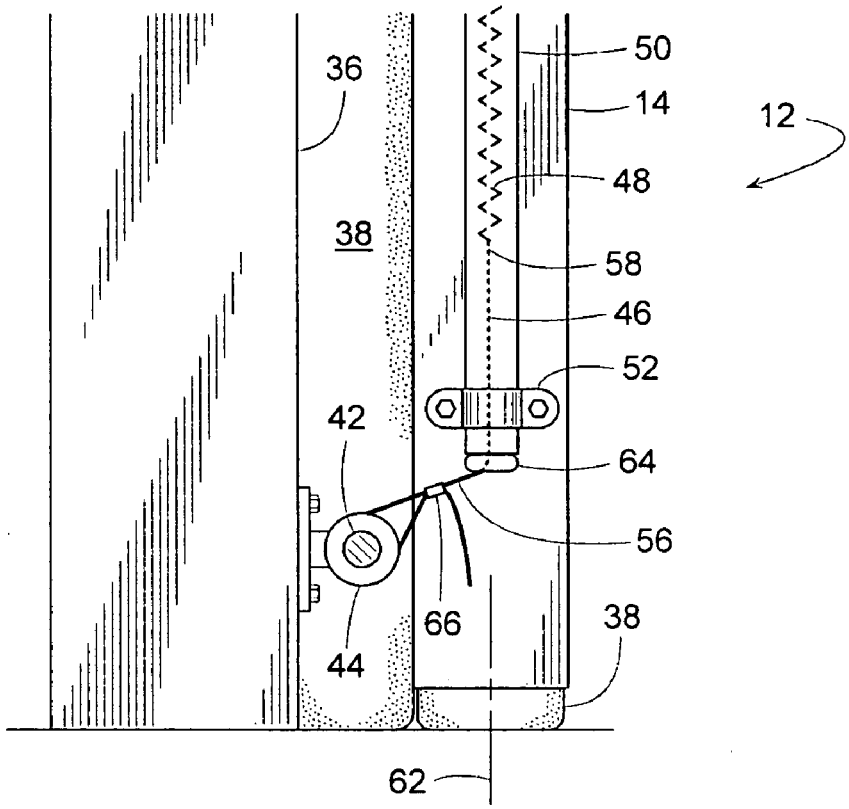
FIG. 4 is a left end view of the left side door panel of FIGS. 1-3, wherein the resilient connection is in a normal mode.
Figure 5:
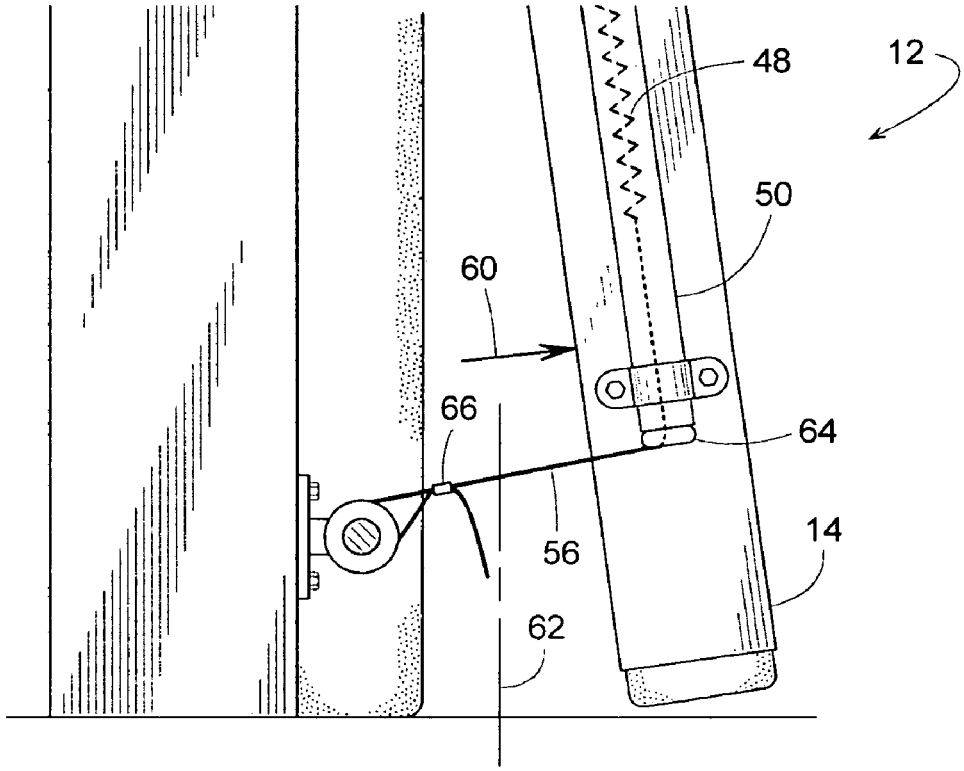
FIG. 5 is similar to FIG. 4 but showing the resilient connection is in a yield mode.

Lower track 42 and/or panel retention system 40 includes a resilient connection that helps protect the door from damage should a collision force panel 14 or 16 beyond its normal path. Referring further to FIGS. 4 and 5, a resilient connection 46 can be incorporated into panel retention system 40. In this case, resilient connection 46 comprises a tension spring 48 disposed within a tube 50 that is attached to either panel by way connectors 52. An upper end 54 of spring 48 is fixed relative to tube 50, and an elongate member 56 (strap, chain, rope, cable, wire, elastic cord, etc.) connects a lower end 58 of spring 48 to track follower 44. Although spring 48 is a tension spring, it should be obvious to those skilled in the art to modify the design to instead use a compression spring, elastic cord, or other resiliently flexible device. In this example, track follower 44 is a plastic sleeve and lower track 42 is a round metal rod.

If an external force 60 forces panel 14 beyond its predetermined normal path 62 (FIG. 5), elongate member 56 is pulled out from within tube 50, which stretches spring 48. The resulting tension in spring 48 and elongate member 56 resiliently and automatically returns panel 14 back to its normal path 62 once force 60 is removed. In some cases, friction between elongate member 56 and the bottom edge of tube 50 can be avoided by installing a smooth eyebolt 64 directly underneath tube 50, whereby elongate member 56 feeds through the eyebolt.

To adjust the preload or initial tension in spring 48, the distance between lower end 58 and track follower 44 can be adjusted by using a conventional buckle or clasp 66 to vary the effective length of elongate member 56. Shortening the effective length of elongate member 56 increases the tension in spring 48.

Figure 6:
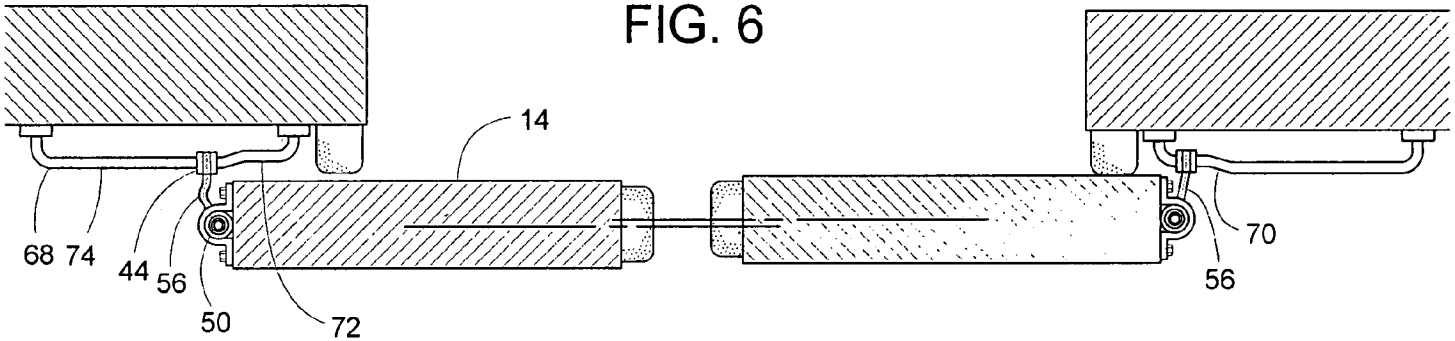
FIG. 6 is a cross-sectional view looking down on a door similar to that of FIG. 2 but showing a slightly modified track and panel retention system.
Figure 8:
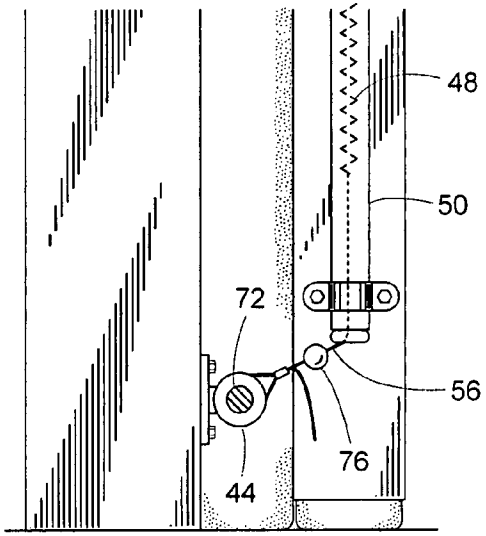
FIG. 8 is a right end view of a panel of the door shown in FIG. 6.
Figure 7:
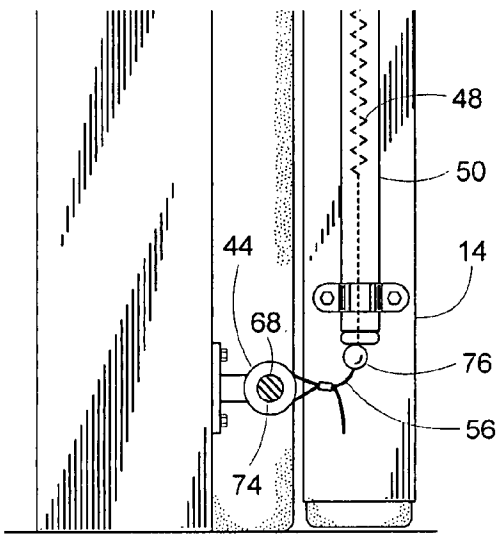
FIG. 7 is a left end view of a panel of the door shown in FIG. 6.

The preload of spring 48 is especially important in helping press panel 14 against seal material 38 when the door is closed. The preload, however, is less important and may even be a detriment that slows the movement of the door panel when the door opens and closes. So, FIGS. 6, 7 and 8 show an embodiment where the tension in elongate member 56 is greater when the door is closed than open. In this case, lower track 68 includes a jog (or even just a gradual slope away from the wall) 70 to create a short recessed portion 72 and a longer protruding portion 74. Recessed portion 72 causes track follower 44 to pull elongate member 56 further out of tube 50 than when track follower 44 is on protruding portion 74. Also, a stop 76 is attached to elongate member 56. Stop 76 does not fit into tube 50, so stop 76 limits how far spring 48 can pull elongate member 56 inside tube 50. Consequently, when track follower 44 is on protruding portion 74, as shown by panel 14 in FIGS. 6 and 7, elongate member 56 is slack, which minimizes the friction or drag between track follower 44 and protruding portion 74. But, when the door is closed, track follower 44 is on recessed portion 72, which applies tension to elongate member 56 as shown in FIG. 8.

Figure 9:
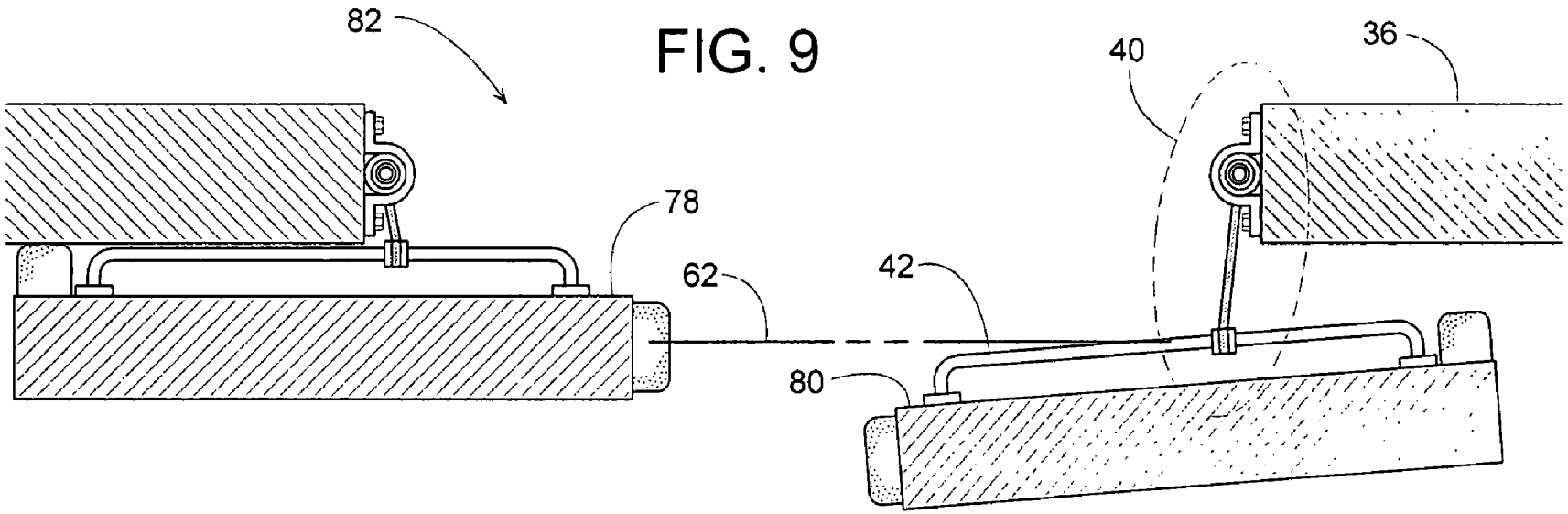
FIG. 9 is a cross-sectional view looking down on a door similar to that of FIG. 2 but showing the positions of the track and panel retention system interchanged with each other.

FIG. 9 shows how the mounting positions of panel retention system 40 and lower track 42 can be interchanged, wherein panel retention system 40 is attached to wall 36, and lower track 42 is attached to panels 78 and 80. The structure and function of doors 12 and 82 are otherwise similar.

Figure 10:
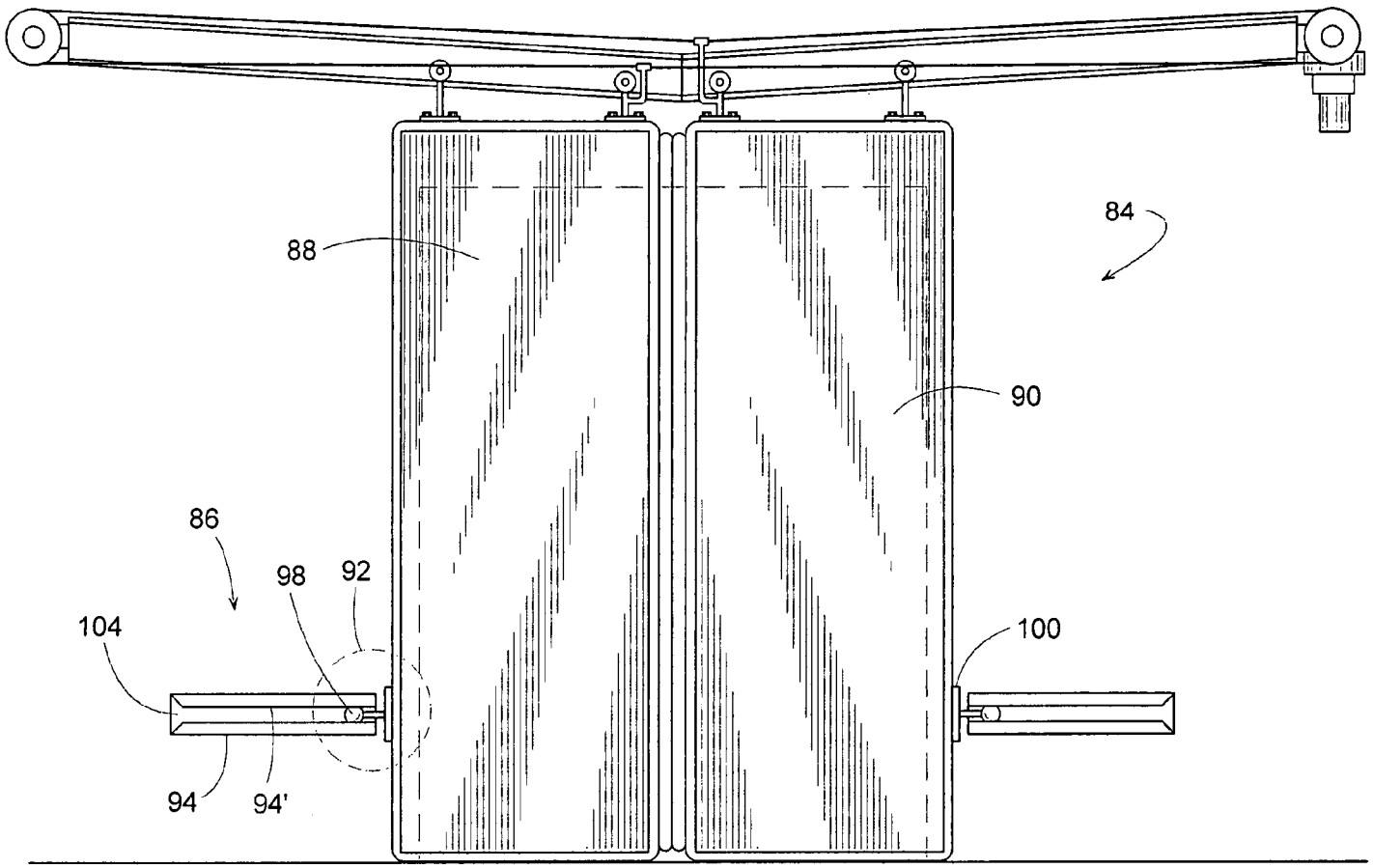
FIG. 10 is similar to FIG. 1 but showing another embodiment of a door.
Figure 11:
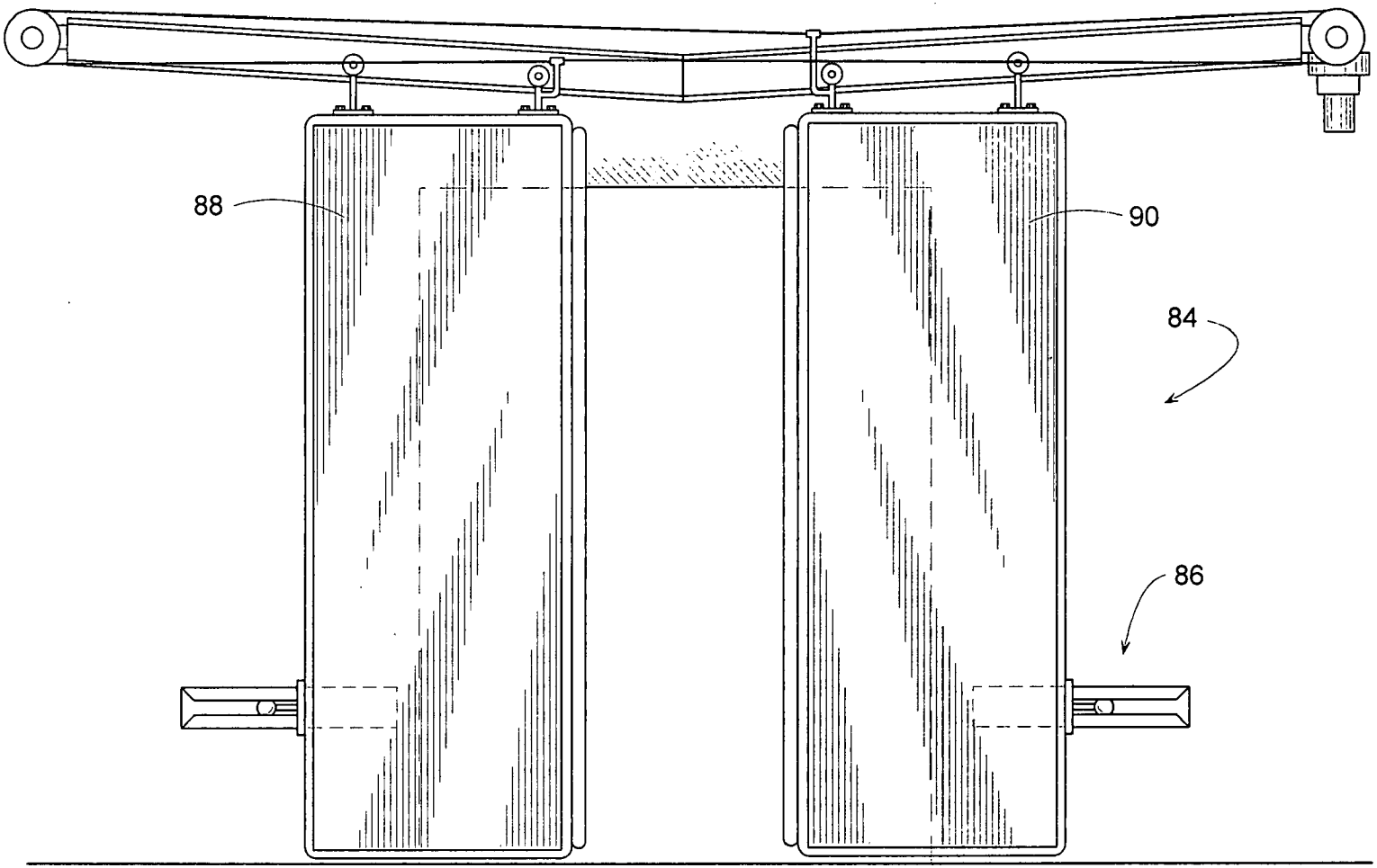
FIG. 11 is similar to FIG. 2 but showing the door of FIG. 10.
Figure 12:
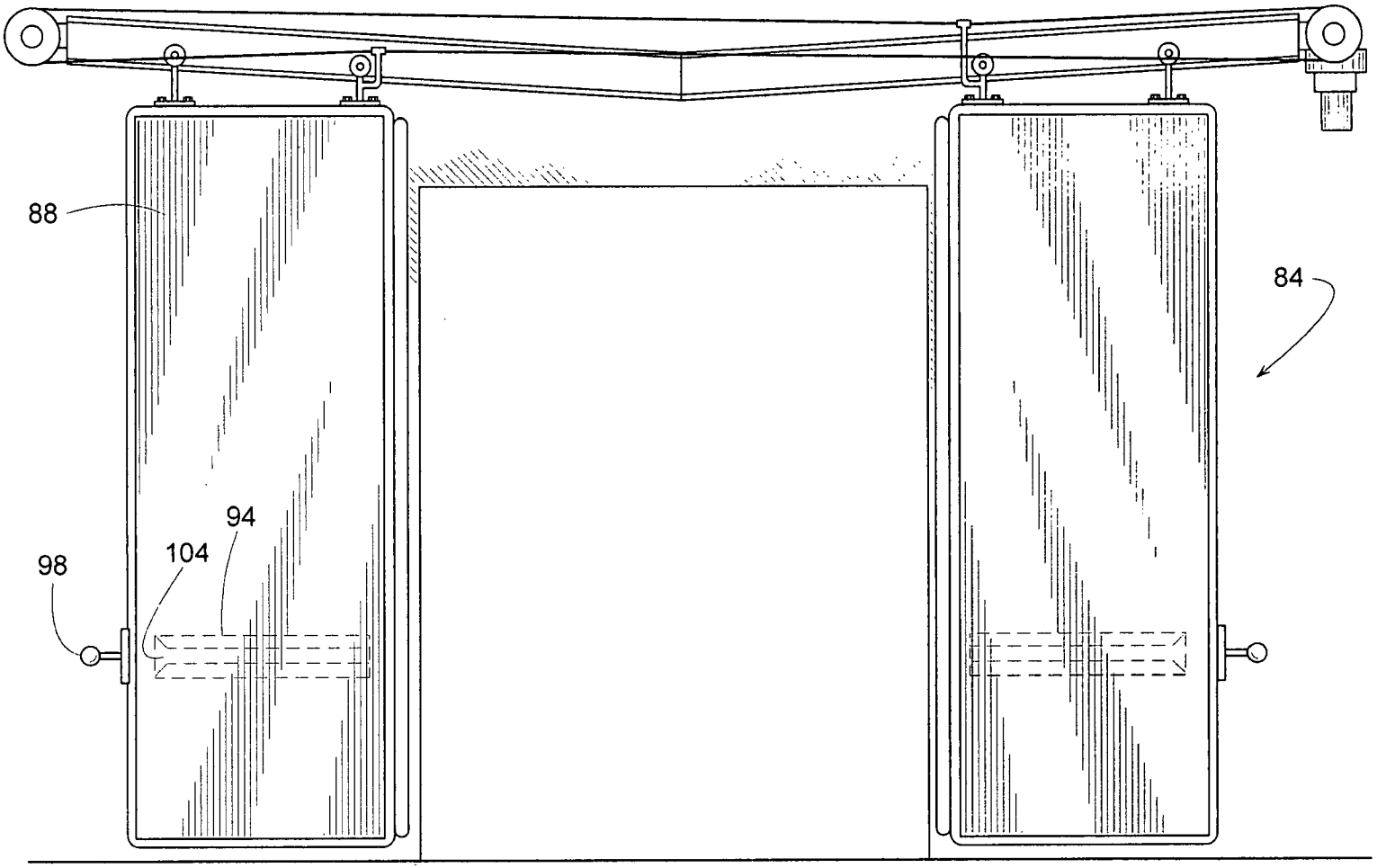
FIG. 12 is similar to FIG. 3 but showing the door of FIG. 10.
Figure 13:
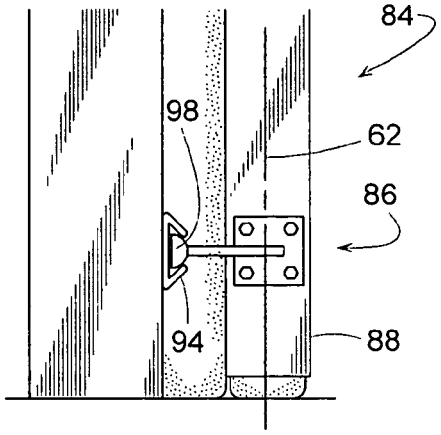
FIG. 13 is a left end view of a panel of the door shown in FIG. 10.
Figure 19:
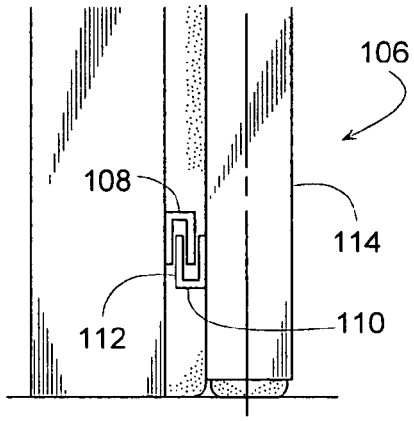
FIG. 19 is similar to FIG. 13 but showing the door of FIG. 16.
Figure 14:
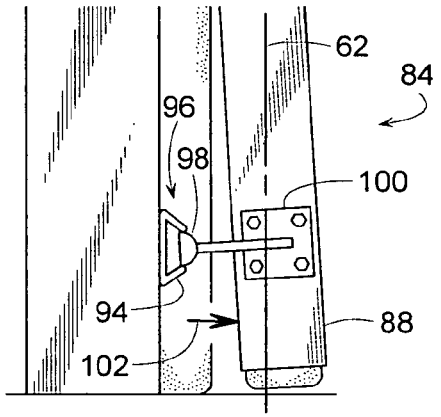
FIG. 14 is similar to FIG. 13 but showing resilient deflection caused by an external force acting on the door panel.
Figure 15:
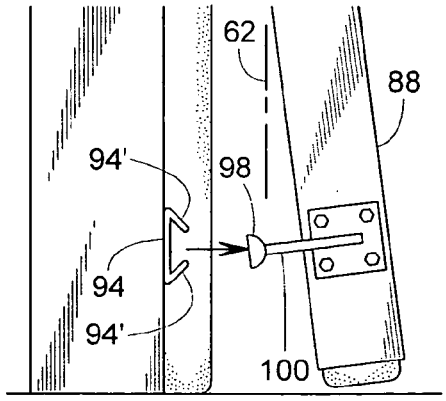
FIG. 15 is similar to FIGS. 13 and 14 but showing the door panel having been forced beyond its predetermined normal travel path.
Figure 21:
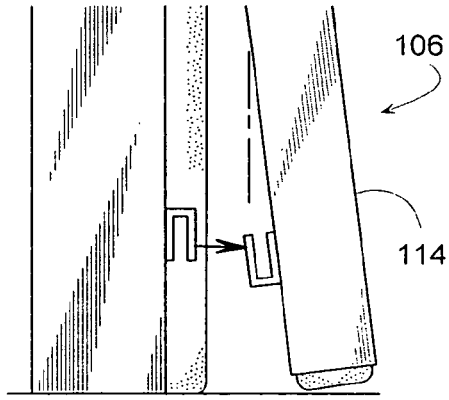
FIG. 21 is similar to FIG. 15 but showing the door of FIG. 16.
Figure 16:
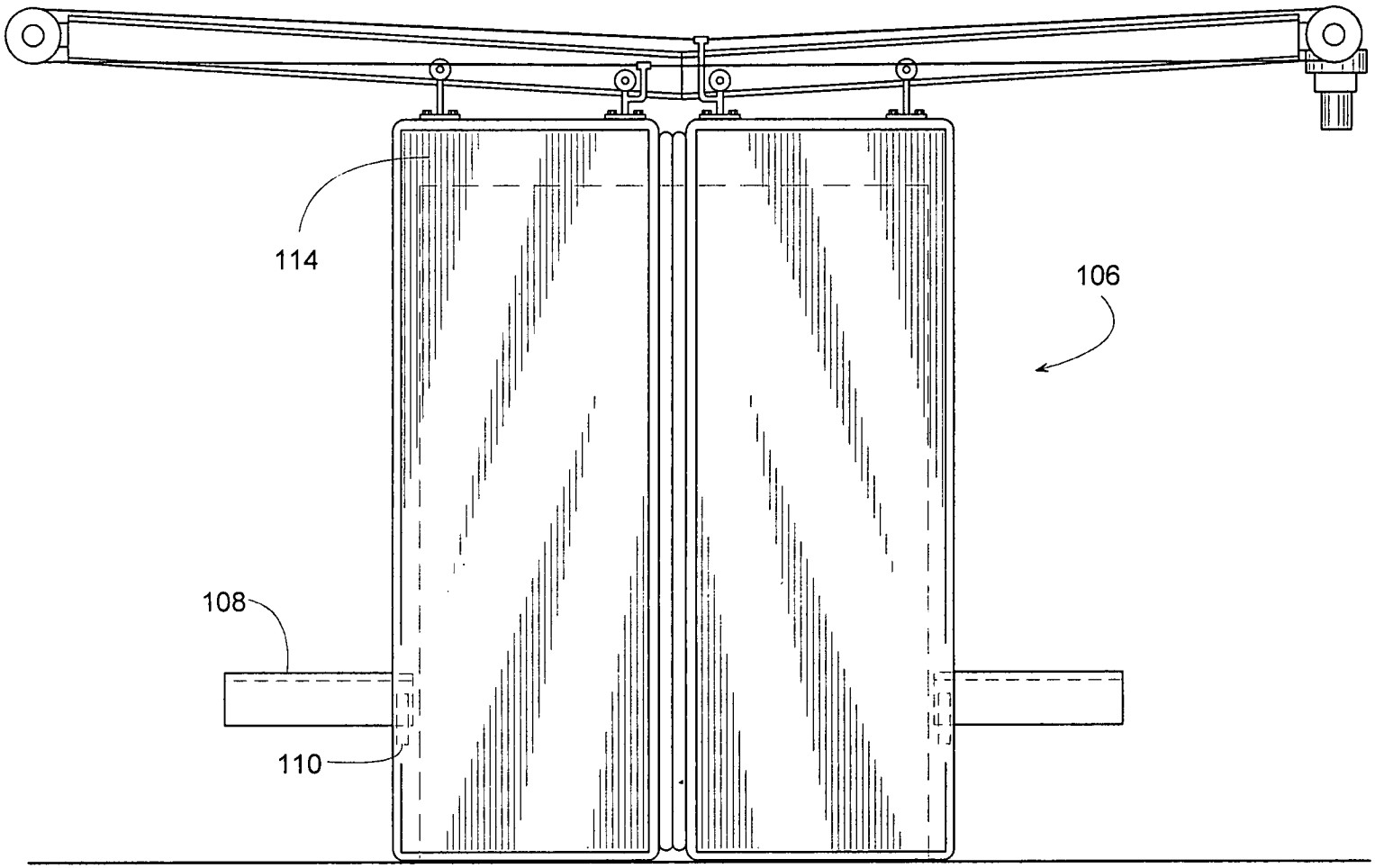
FIG. 16 is similar to FIGS. 1 and 10 but showing yet another embodiment of a door.
Figure 17:
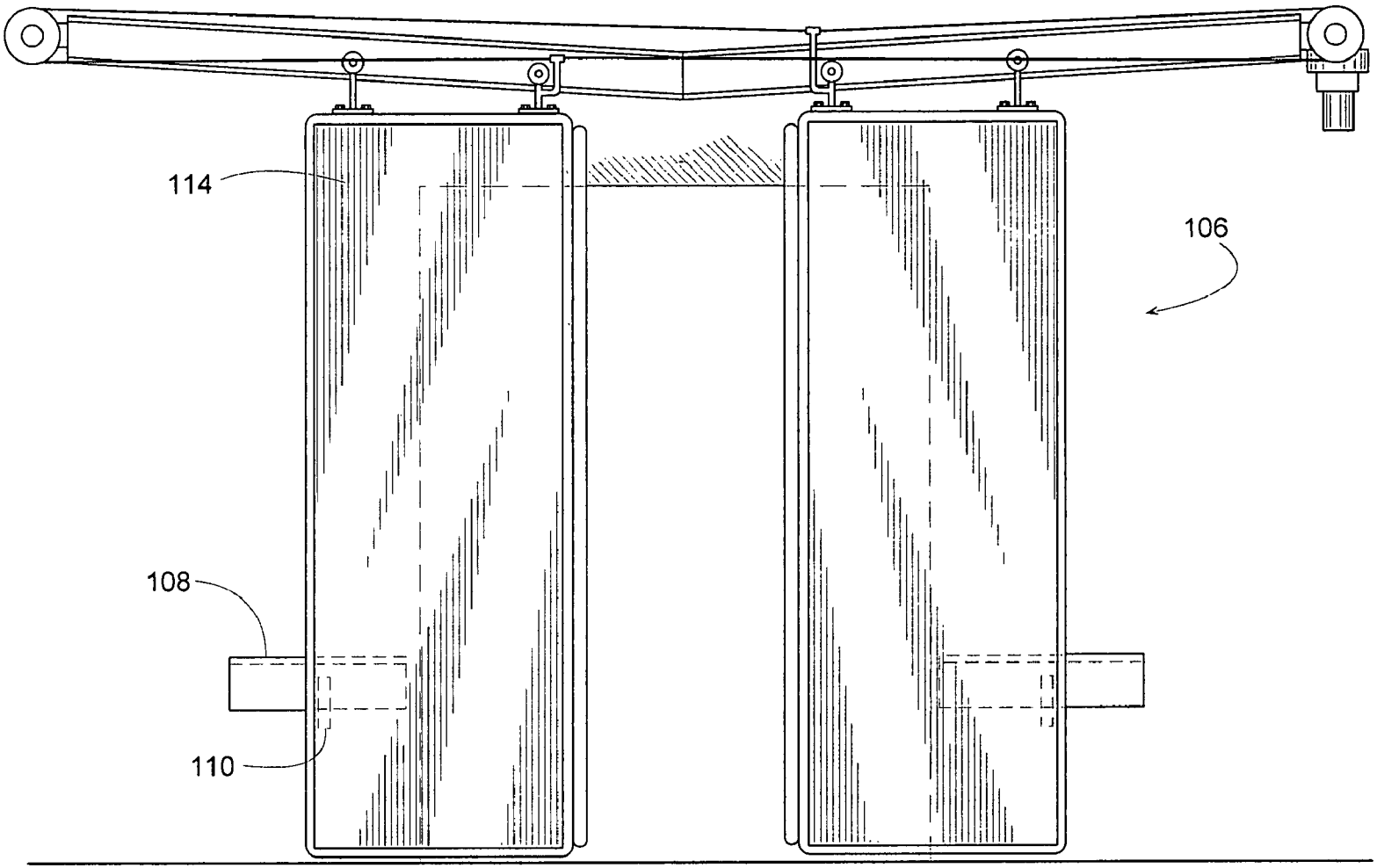
FIG. 17 is similar to FIGS. 2 and 11 but showing the door of FIG. 16.

FIGS. 10, 11 and 12 show a sliding door 84 that includes another embodiment of a resilient panel restraint 86. FIGS. 10, 11 and 12 correspond to FIGS. 1, 2 and 3 respectively. Each panel 88 and 90 of door 84 includes a panel retention system 92 that engages a lower track 94; however, a resilient connection 96 (FIG. 14) of door 84 is provided in a different manner. FIGS. 13, 14 and 15 are various end views illustrating a track follower 98 being resiliently released from within track 94. In this case, resilient connection 96 is provided by the resilience of track 94 and/or track follower 98 of panel retention system 92. Panel retention system 92 comprises track follower 98 and a bracket 100 that connects track follower 98 to panel 88.

If an external force 102 forces panel 88 beyond its predetermined normal path 62, the resilient flexibility of track follower 98 and/or the resilient flexibility of the lower track's flanges 94' allows track follower 98 to escape from within track 94 as shown in FIG. 15. Once released, track follower 98 automatically returns to within track 94 by simply opening and closing door 84. When the door is fully open, as shown in FIG. 12, panel 98 moves its track follower 98 to the left side of track 94. Then, as panel 88 begins closing, panel 88 automatically feeds track follower 98 back into an open entrance 104 of track 94, whereby the door automatically returns to its normal operation.

Figure 20:
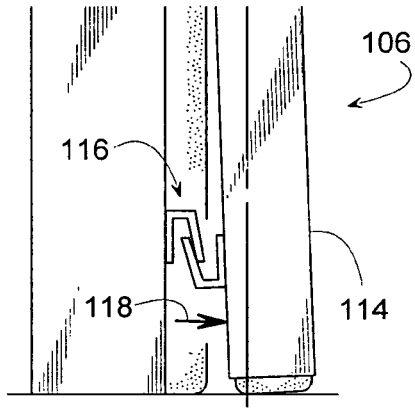
FIG. 20 is similar to FIG. 14 but showing the door of FIG. 16.

Another door 106 is similar to door 84 and is illustrated in FIGS. 16-21, which correspond to FIGS. 10-15 respectively. With door 106, however, a lower track 108 replaces track 94, and panel retention system 110 replaces system 92. Panel retention system 110 is a short U-shaped member having one leg of the U-shape serve as a track follower 112 and the rest of the U-shape serve as means for connecting track follower 112 to panel 114. Track 108 is an inverted U-shaped piece that is longer than panel retention system 110. The resilient flexibility of panel retention system 110 and/or track 114 provide a resilient connection 116 between the two as shown in FIG. 20. Resilient connection 116 allows an external force 118 to temporarily separate track follower 112 from track 108, thereby protecting panel 114 from damage.

Figure 18:
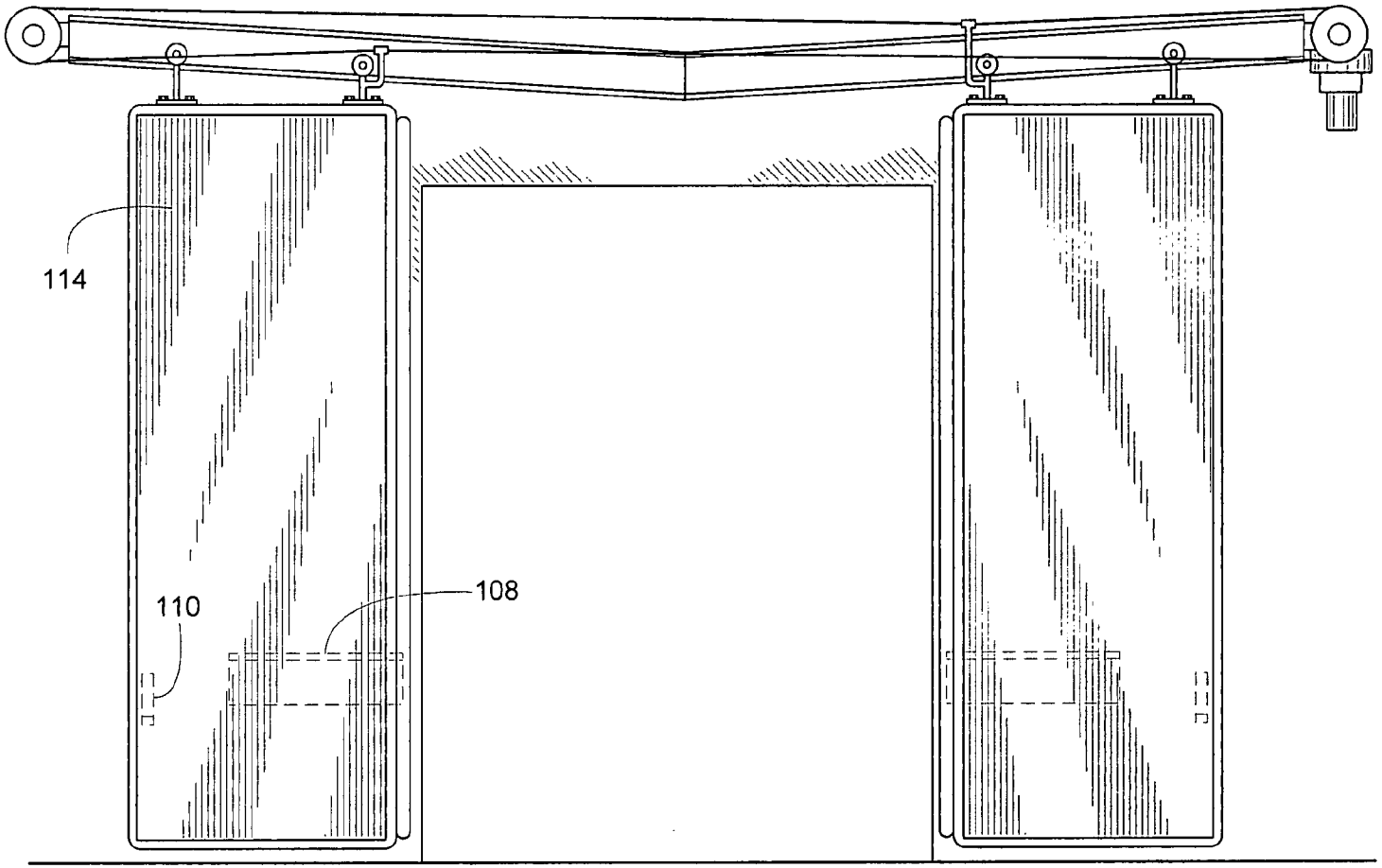
FIG. 18 is similar to FIGS. 3 and 12 but showing the door of FIG. 16.
Figure 22:
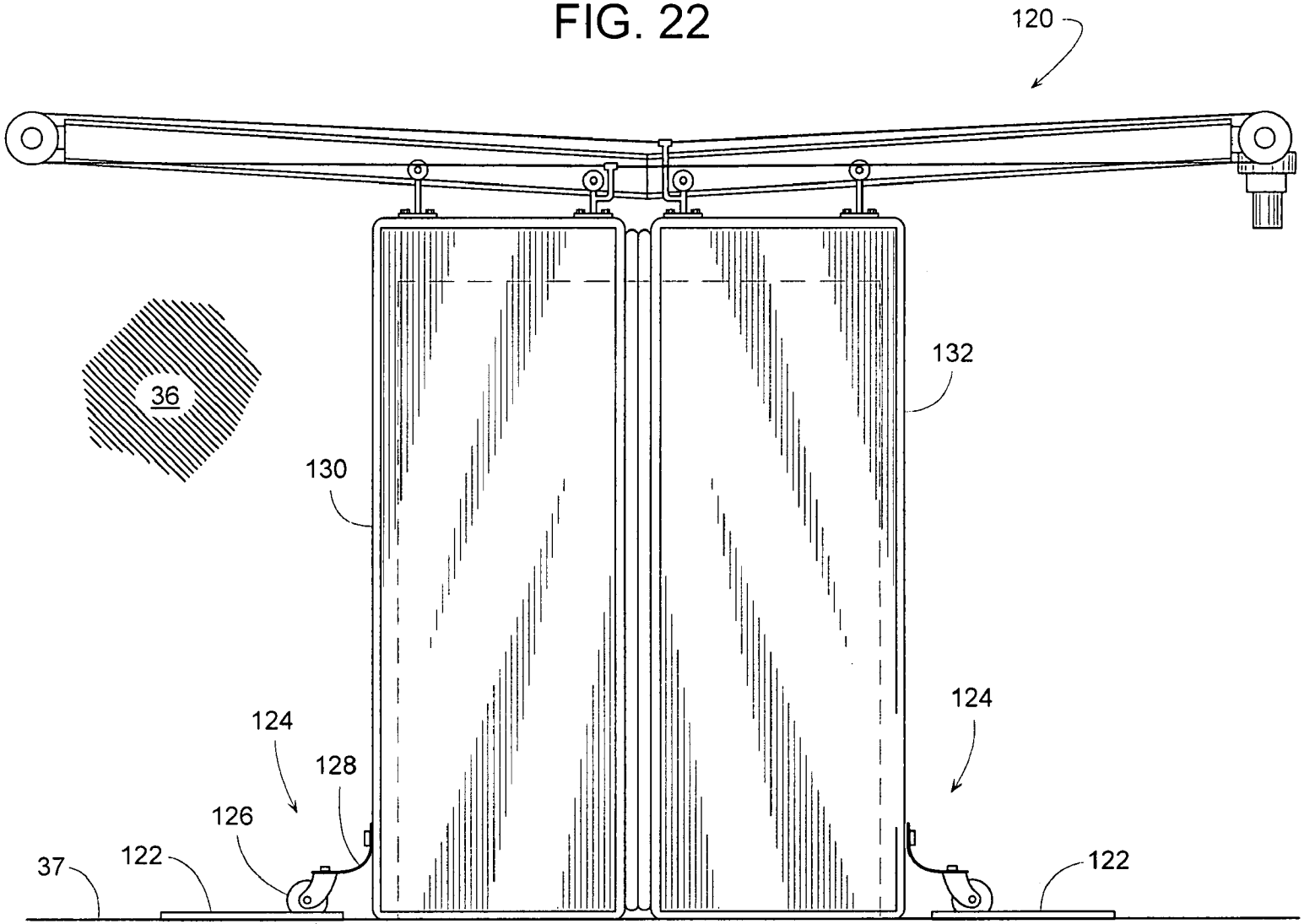
FIG. 22 is similar to FIGS. 1 and 10 but showing still yet another embodiment of a door.
Figure 23:
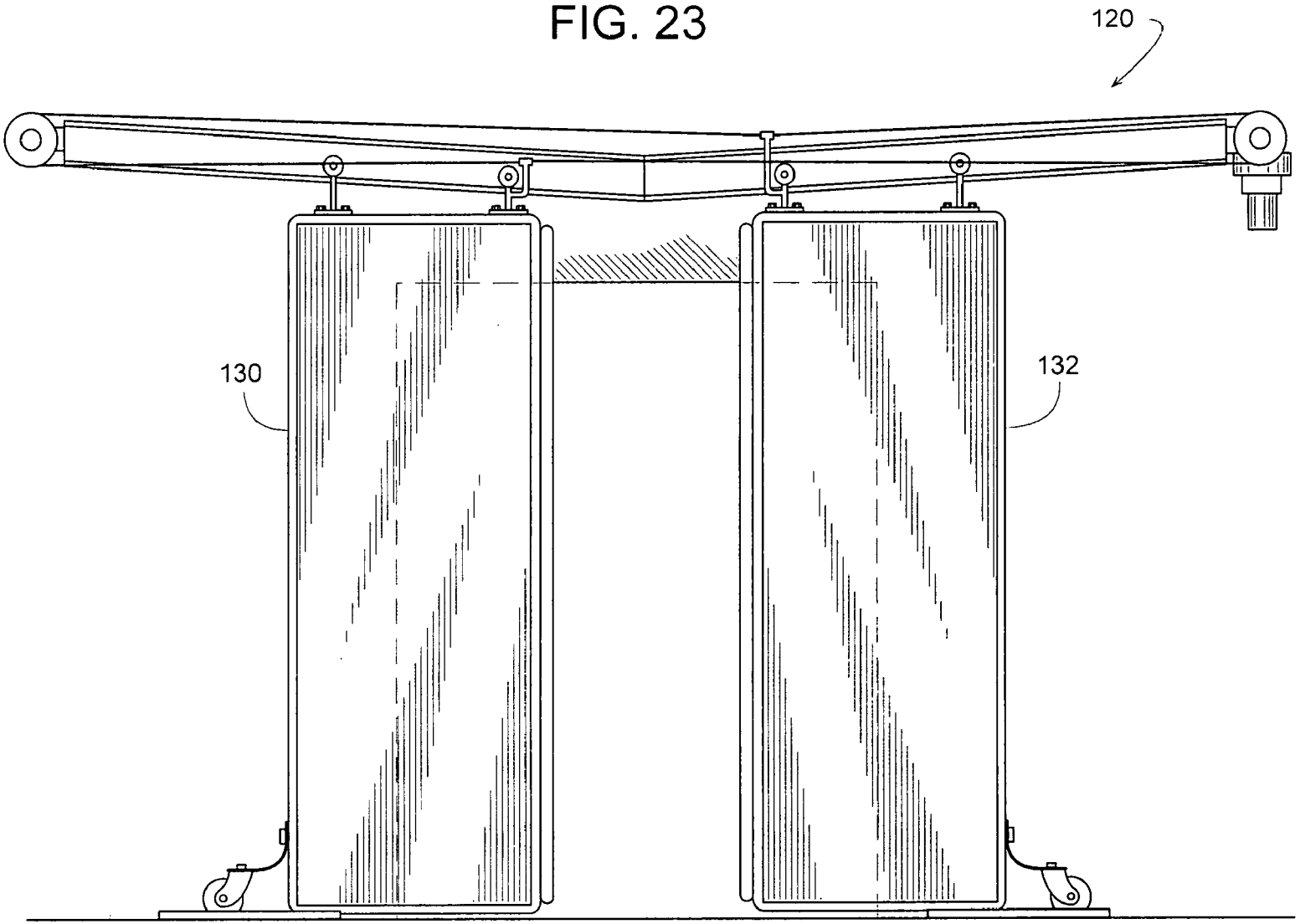
FIG. 23 is similar to FIGS. 2 and 11 but showing the door of FIG. 22.

Once released, track follower 112 automatically returns to within track 108 by simply opening and closing door 106. When the door is fully open, as shown in FIG. 18, panel 114 moves its track follower 110 to the left side of track 108. Then, as panel 114 begins closing, panel 114 automatically feeds track follower 110 back underneath track 108, whereby the door automatically returns to its normal operation.

Figure 26:
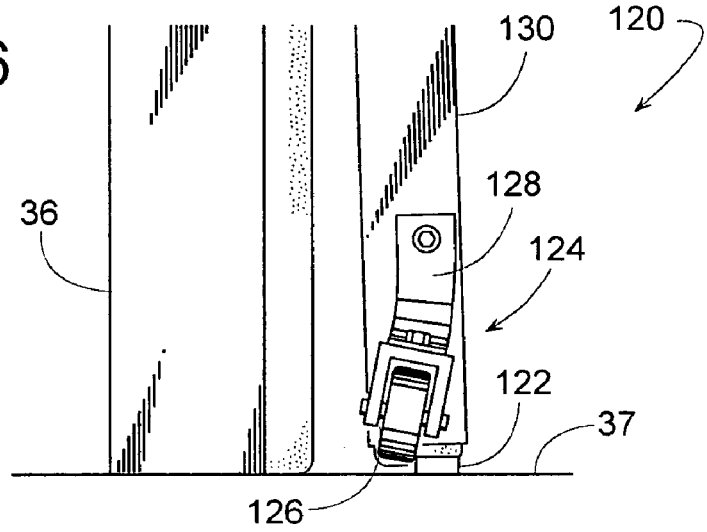
FIG. 26 is similar to FIG. 14 but showing the door of FIG. 22.
Figure 27:
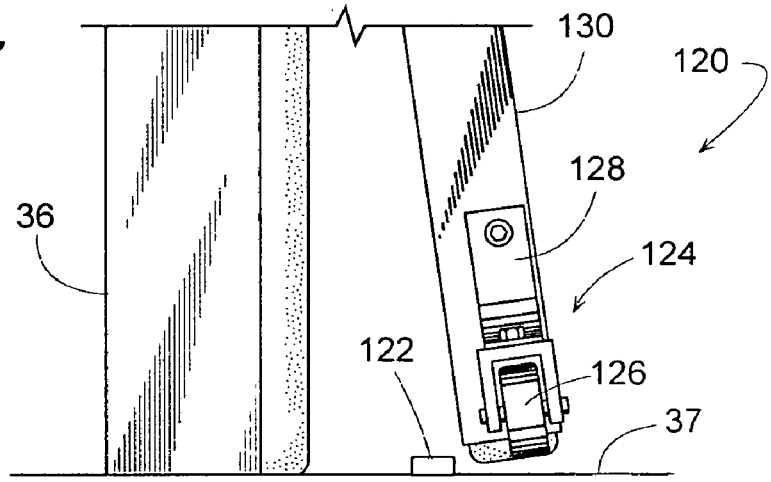
FIG. 27 is similar to FIG. 15 but showing the door of FIG. 22.
Figure 28:
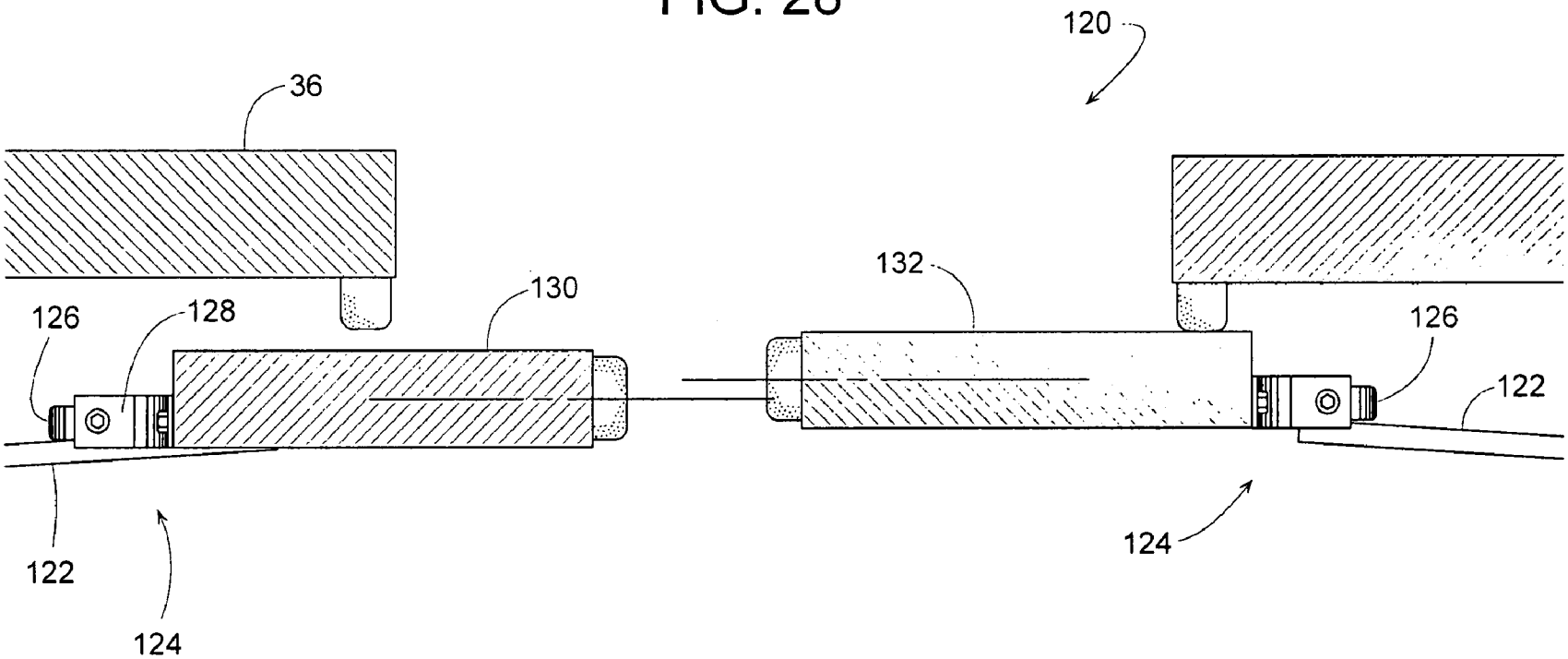
FIG. 28 is similar to FIG. 6 but showing the door of FIG. 22.

Yet another door 120, similar to door 84, is illustrated in FIGS. 22-28, with FIGS. 22-27 corresponding to FIGS. 10-15 respectively. A top view of door 120 is shown in FIG. 28, which is similar to FIG. 6. With door 120, a lower track 122 is mounted to floor 37 to replace track 94, and panel retention system 124 replaces system 92. Panel retention system 124 comprises a track follower or a roller 126 that a strip of spring steel 128 connects to a panel such as panel 130 or 132. Strip 128 provides a resilient connection between roller 126 and panels 130 or 132. The resilience of strip 128 allows a door panel to returnably breakaway from its normal path and enables roller 126 to accommodate the varying vertical clearance between the bottom edge of a door panel and floor 37 as the panel opens and closes. In some cases, strip 4 may actually lift roller 126 off the surface of floor 37 as the panel fully opens.

Figure 25:
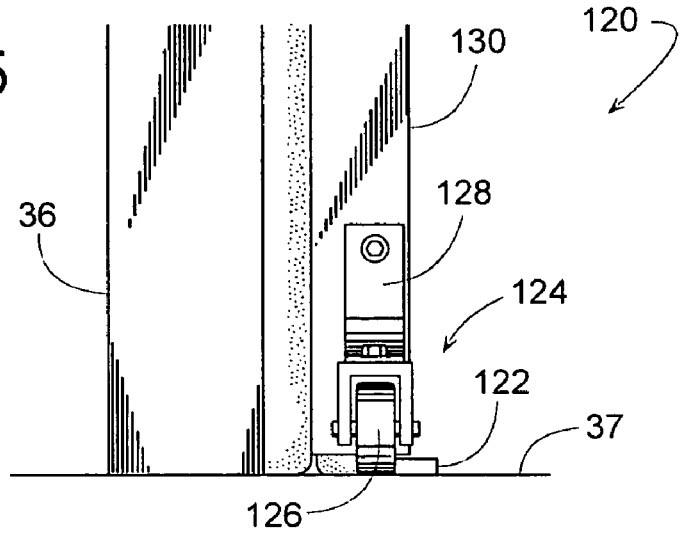
FIG. 25 is similar to FIG. 13 but showing the door of FIG. 22.

During normal operation, roller 126 is between track 122 and wall 36 and rolls along or just above floor 37, as shown in FIG. 25. In this location, the lateral engagement between roller 126 and track 122 helps keep door panel 130 in its normal path. When door panel 130, however, is forced away from wall 36, as shown in FIGS. 26 and 27, the flexibility of strip 128 allows roller 126 to "pop" up and over track 122 to release panel 130 from its normal path.

Figure 24:
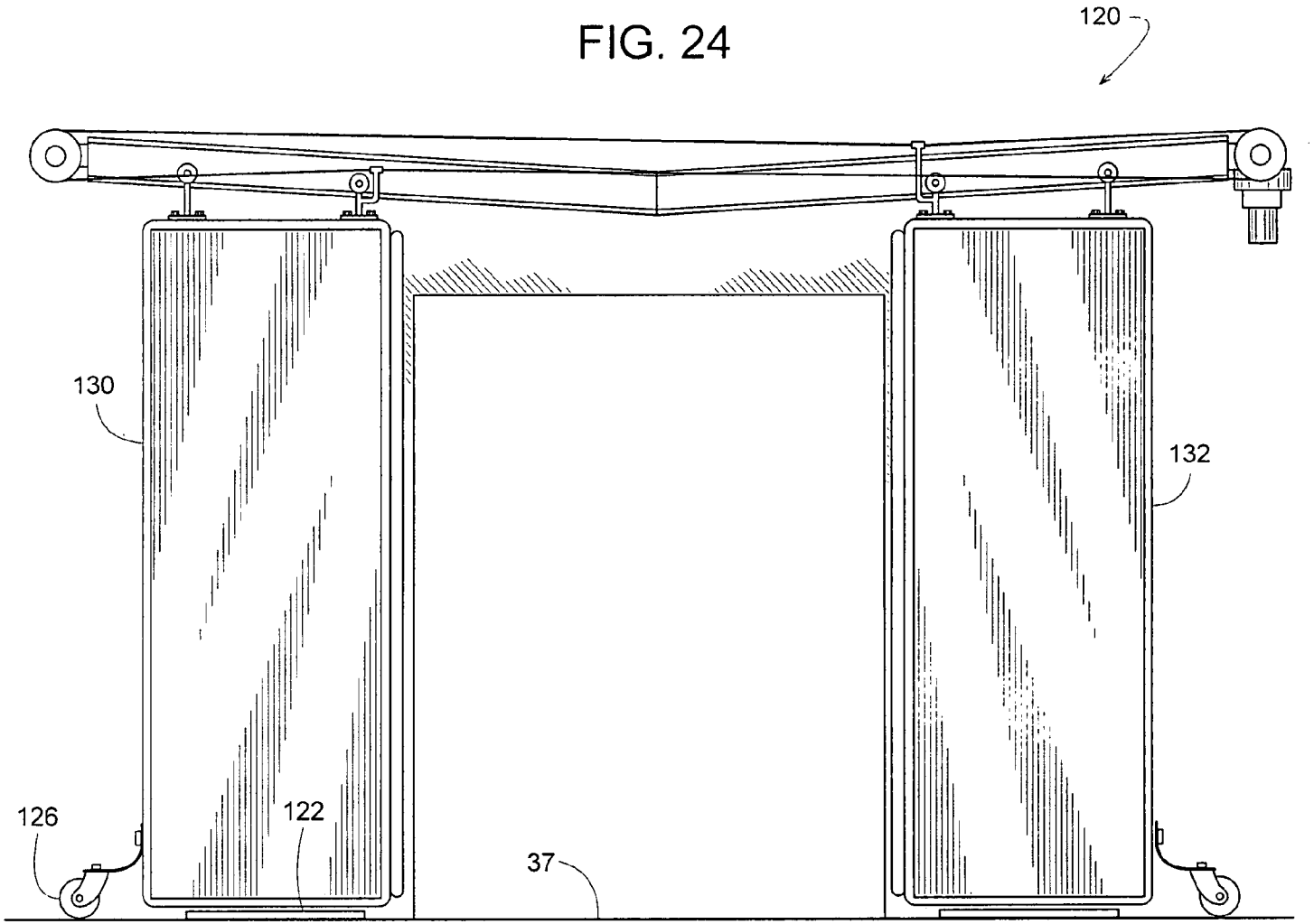
FIG. 24 is similar to FIGS. 3 and 12 but showing the door of FIG. 22.

Once released, roller 126 automatically returns to its proper location, between track 122 and wall 36, by simply opening and closing door 120. When the door is fully open, as shown in FIG. 24, panel 130 moves roller 126 to the left side of track 122. Then, as panel 130 begins closing, panel 130 automatically feeds roller 126 back in between track 122 and wall 36, whereby the door automatically returns to its normal operation.

Track 122 is preferably installed at a slight angle to wall 36, as shown in FIG. 28. With track 122 being at an angle, track 122 forces a closed panel, such as panel 132, tightly against its seals, yet track 122 releases the pressure against the seals of an opening panel, such as panel 130.

Although the invention is described with reference to a preferred embodiment, it should be appreciated by those skilled in the art that various modifications are well within the scope of the invention. Therefore, the scope of the invention is to be determined by reference to the claims that follow.

We claim:

1. A door for at least partially covering a doorway and movable relative thereto, the doorway being defined by a surrounding structure that includes a wall such that the doorway has a width, the door comprising:

an upper track;

a door panel suspended from the upper track and being movable horizontally relative to the doorway along a predetermined normal path;

a lower track disposed below the upper track, wherein the lower track is attachable to the surrounding structure such that the lower track is entirely outside the width of the doorway;

a panel retention system comprising:

a track follower movably coupled to the lower track; and a housing mounted on the door panel along a longitudinal side of the door panel and in which a biasing element is positioned, wherein the biasing element is operatively coupled to the track follower and has a longitudinal axis that is substantially parallel to the longitudinal side of the door panel, wherein an interaction between the biasing element and the track follower at least partially guides the door panel along the predetermined normal path, wherein the biasing element limits movement of the door panel out of the predetermined normal path, wherein if the door panel moves out of the predetermined normal path, the track follower remains in contact with the lower track and the biasing element is extended.

2. The door of claim 1, wherein the lower track comprises a stationary bar.

3. The door of claim 1, wherein the interaction between the biasing element and the track follower urges the door panel toward the predetermined normal path when the door panel is out of the predetermined normal path.

4. The door of claim 1, wherein the housing comprises a tube.

5. The door of claim 1, wherein the biasing element comprises a tension spring.

6. The door of claim 1, further comprising a pliable elongate member that operatively couples the biasing element and the track follower.

7. The door of claim 6, wherein the pliable elongate member has a length that is adjustable to vary a resiliency of the pliable elongate member.

8. The door of claim 1, wherein the panel retention system includes a resilient connection.

9. The door of claim 1, wherein the biasing element urges the door panel toward the predetermined normal path when the door panel is out of the predetermined normal path.

10. The door of claim 1, wherein the lower track comprises a contour to guide the movement of the track follower along the lower track.

11. The door of claim 1, wherein the track follower comprises an annular track follower.

12. A door movable relative a doorway defined by a wall and a floor, wherein the doorway defines a path of pedestrian and vehicle travel through the wall and wherein the door may be subjected to an impact force, the door comprising:

an upper track;

a door panel suspended from the upper track and being movable horizontally across the doorway along a predetermined normal path;

a lower track disposed below the upper track, attachable to the wall, and configured to be disposed above the floor such that no portion of the lower track extends into the doorway;

a panel retention system comprising:

a housing mounted on a longitudinal side or face of the door panel and in which a biasing element is positioned, wherein a longitudinal axis of the housing is substantially parallel to the longitudinal side or face of the door panel;

a track follower movably coupled to the lower track to at least partially guide the door panel along the predetermined normal path; and an elongate member having a first end coupled to the biasing element and a second end engaging the track follower, wherein an interaction between the housing, the biasing element and the elongate member at least partially extends the biasing element within the housing when the door panel moves out of the predetermined normal path.

13. The door of claim 12, wherein the track follower remains in contact with the lower track even if the door panel moves out of the predetermined normal path.

14. The door of claim 12, wherein an interaction between the biasing element, the track follower and the elongate member urges the door panel to return to the predetermined normal path after the door panel moves out of the predetermined normal path.

15. The door of claim 12, wherein the lower track comprises a stationary bar.

16. The door of claim 12, wherein an interaction between the biasing element and the track follower urges the door panel toward the predetermined normal path when the door panel is out of the predetermined normal path.

17. The door of claim 12, wherein the housing comprises a tube.

18. The door of claim 12, wherein the biasing element comprises a tension spring.

19. The door of claim 12, wherein the elongate member is pliable and has a length that is adjustable to vary a resiliency of the elongate member.

20. The door of claim 12, wherein the track follower remains in contact with the lower track even when the door panel is out of the predetermined normal path.

21. The door of claim 12, wherein the elongate member is resilient.

* * * * *

UNITED STATES PATENT AND TRADEMARK OFFICE

CERTIFICATE OF CORRECTION

PATENT NO. : 7,757,437 B2
APPLICATION NO. : 10/754812
DATED : July 20, 2010
INVENTOR(S) : Schulte et al.

It is certified that error appears in the above-identified patent and that said Letters Patent is hereby corrected as shown below:

Column 8, line 6, change the first occurrence of "the" to --a--.

Column 8, line 33 (claim 12), after "longitudinal" delete "side or".

Column 8, line 36 (claim 12), after "longitudinal" delete "side or".

Signed and Sealed this
Twenty-fifth Day of January, 2011

David J. Kappos

David J. Kappos
*Director of the United States Patent and Trademark Office*